United States Patent [19]

Otsuki et al.

[11] 4,196,893

[45] Apr. 8, 1980

[54] SHAFT FURNACE

[75] Inventors: Naoki Otsuki, Himeji; Katsuyoshi Kobayashi, Kitakyushu, both of Japan

[73] Assignee: Nippon Steel Corporation, Tokyo, Japan

[21] Appl. No.: 886,657

[22] Filed: Mar. 15, 1978

[30] Foreign Application Priority Data

Mar. 18, 1977 [JP] Japan ..... 52-29880

[51] Int. Cl.[2] ..... C21B 1/06

[52] U.S. Cl. ..... 266/199; 266/159; 266/176

[58] Field of Search ..... 266/176, 197, 198, 199, 266/159

[56] References Cited

U.S. PATENT DOCUMENTS 1,403,283 1/1922 Batchelor ..... 266/176 X

*Primary Examiner*—M. J. Andrews

*Attorney, Agent, or Firm*—Toren, McGeady and Stanger

[57] ABSTRACT

A shaft reduction furnace is provided with a pressure equalizing chamber for supplying raw materials such as ores in the furnace. The interior of the furnace is separated by a dividing plate into an upper portion and a lower portion. A pipe path through the dividing plate communicates the upper portion with lower portion. The upper portion and the pipe path form an inside ore hopper for supplying ore continuously into the lower portion of the furnace, thus omitting the conventional ore hopper of pressure-proof-structure provided separately outside of the furnace.

4 Claims, 8 Drawing Figures

SHAFT FURNACE

FIELD OF THE INVENTION

The present invention relates to improvements of the top structure of a shaft furnace, such as a blast furnace, and more particularly a combination of an ore supplying system with a shaft furnace.

For reduction of ores, such as iron ores, in a shaft furnace, the top structure of the shaft furnace must have a system for exhausting the reduction exhaust gas under a predetermined pressure outside the furnace, a charging system for charging raw ores into the furnace, means for controlling the ore charge level in the furnace, means for maintaining a predetermined pressure in the top of the furnace and other means.

The above mentioned systems and means must be stronger and more rigid in correspondence to increased pressures inside the furnace, and must be larger in their size in correspondence to enlarged diameters of the furnace. Thus it is a general tendency that the total height of the furnace is considerably increased, thus causing surprisingly increased capital cost.

For example, in case of a blast furnace provided with a bell-type charging device as shown in FIG. 1, when the charge level in the furnace 1 lowers by a certain degree, the raw material including the ore 3 is charged in a batch manner from the charging device 2.

As the bell-type charging device other than the device shown in FIG. 1, there have been conventionally known a three-bell system in which further a third bell is provided at a higher position, or a valve-bell system in which a sealing valve is provided, and these systems are used for a blast furnace to be operated under a high-pressure. These systems, however, have a defect that a blast furnace incorporated with these systems is remarkably increased in its height as a whole.

Meanwhile, when the diameter of a blast furnace is increased, there is a remarkable tendency that the level of the charge in the furnace is not uniform, with a marked difference in the level between the central portion and the circumferential portion which adversely affects the distribution of gas flow within the furnace, causing difficulties in the furnace operation. In order to eliminate this level difference, a device for adjusting the charge distribution, for example a movable armor, is required.

A top structure of another conventional shaft furnace for reduction of iron ore is schematically shown in FIG. 2, wherein an ore hopper 5 is provided above the reduction furnace, connected therebetween by a pipe 6 through which the ore flows down, and one or more ore supplying system 7 comprising a pressure equalizing chamber which can seal the furnace pressure is connected to the top of the hopper 5. On the top portion of the furnace 4 there are provided exhaust gas conduits 8.

When the ore charge in the furnace 4 goes down, the ore in the hopper 5 flows down by its gravity through the pipe 6 to form the charge level in the furnace with its summit formed at the lower end of the pipe 6 and with its slope having a repose angle inherent to the surface character of the ore, so that a vacant space not occupied by the ore is formed between the dividing plate and the charge stock line extending from the lower end of the pipe 6 to the furnace wall.

In the above shaft furnace, as the ore hopper 5 is directly exposed to the pressure within the furnace, it is necessary that the hopper is of such a strong structure that not only can support the load of the ore 3 but also can stand the high furnace pressure, and in order to maintain the required pressure-proof-strength of the hopper 5, it is necessary to keep close control and maintenance for a long period of time over the wear of the hopper 5 caused by the contact with the ore.

On the other hand, when the furnace diameter is increased, and if the ore 3 is charged through only one central pipe 6, the charge level in the central portion of the furnace is naturally higher than that in the circumferential portion, thus hindering a desirable distribution of the gas flow in the furnace.

However when a number of pipes 6 are provided in order to maintain an almost uniform height of the charge level across the furnace, both the hopper 5 and the furnace 4 are confronted with more defects critical to the furnace which is a kind of pressure vessel.

Further, another conventional ore supplying system for charging ores into a reduction furnace is schematically shown in FIG. 3.

According to this conventional structure, a plurality of charge pipes 6 connected to the ore hopper 5 outside the furnace are made to extend into the inside of the furnace without provision of a pressure equalizing chamber, and the hopper 5 is designed to be filled with $N_2$ gas and the ore layer in the pipe 6 is caused to resist against and seal the furnace gas. This structure has a defect that the length of the charge pipe must be markedly increased when the furnace pressure is increased as in a high-pressure operation and thus the furnace height as a whole including the ore supplying system is considerably increased.

SUMMARY OF THE INVENTION

One of the objects of the present invention is to provide an improved top structure of a shaft furnace, and the features of the present invention reside in improvements of a shaft furnace provided at its top portion with a pressure equalizing chamber for supplying raw materials such as ores, said improvements being characterized in that a dividing plate is provided in the upper portion within the furnace to divide the furnace space into an upper portion for storing the ore therein and a lower portion, that at least one pipe passage is formed to extend downward through the dividing plate through which the ore flows down into the lower portion of the furnace, thus forming an ore hopper inside the furnace, and an exhaust gas conduit is communicated through the furnace wall to a vacant space formed between the dividing plate and a stock line surface of the charge in the lower portion of the furnace.

Therefore, the basic technical idea of the present invention is that a part of the ore supplying system is combined with the top structure of a shaft furnace so as to provide an ore hopper mechanism within the furnace.

According to the present invention, the pressure-proof-structure required for a part of the ore supplying system is formed by the pressure-proof-structure of the shaft furnace itself so that the whole structure can be simplifed. Further, according to the present invention, as the ore hopper mechanism is provided inside the top portion of the furnace, it is very easy to provide a required number of the charging pipes through which the ore flows down continuously in correspondence to the diameter of the furnace, so that an almost uniform charge level (stock line) can be maintained over the central to circumferential portion of the furnace.

As mentioned hereinbefore, the strength of the furnace structure itself must be increased as the furnace pressure under which the furnace is operated is increased. In such a case, if the exhaust gas conduit is provided on the top dome portion of the furnace, the top structure is more complicated and weakened. Therefore, according to the present invention, it is avoided to provide the exhaust gas conduit on the top portion, and the exhaust gas conduit is provided at other portions of the furnace wall. As a result, a vacant space is formed in the top portion of the furnace and this vacant sapce is utilized as the ore hopper (herein called also "inside hopper") in the present invention so that the height of a shaft furnace unit as a whole can be decreased.

Further, according to the present invention, the exhaust gas conduit is provided through the furnace wall below the ore hopper within the furnace, the required pressure resistant structure can be relatively easily assured for the furnace.

BRIEF EXPLANATION OF THE DRAWINGS

FIG. 4(*b*) shows the cross section along the line A–A' in FIG. 4(*a*).

FIG. 6(*b*) shows the cross section along the line A–A' in FIG. 6(*a*).

DESCRIPTION OF PREFERRED EMBODIMENTS

The present invention will be described in detail with reference to the attached drawings, particularly FIGS. 4(*a*) to 6(*b*).

Figure 1:
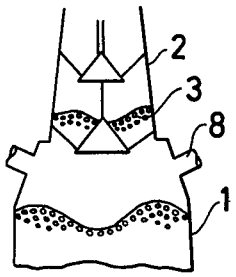
FIG.1 PRIOR ART
FIG. 1 schematically shows a conventional charge supplying system for a blast furnace.
Figure 2:
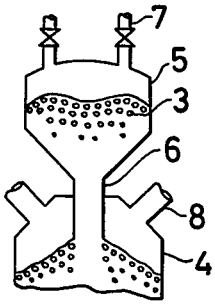
FIG.2 PRIOR ART
FIG. 2 schematically shows the top structure of a conventional shaft furnace.
Figure 3:
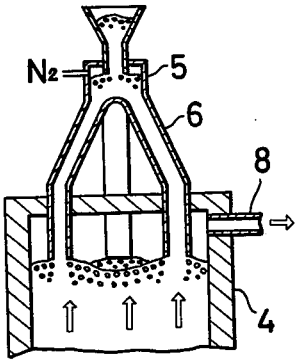
FIG.3 PRIOR ART
FIG. 3 schematically shows the top structure of another conventional shaft furnace.
Figure 4A:
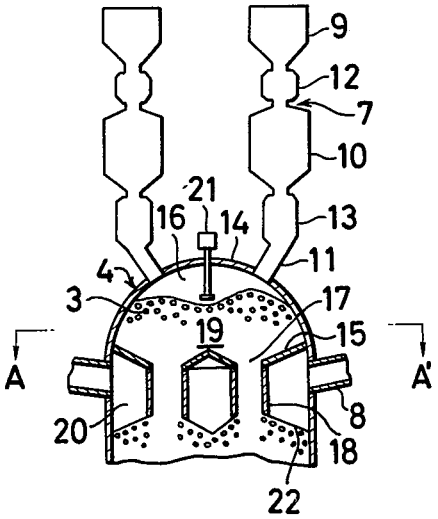
FIG. 4(*a*) schematically shows one embodiment according to the present invention.
Figure 4B:
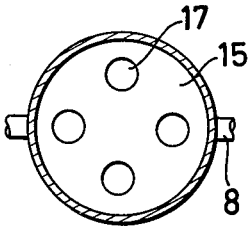

As shown in FIG. 4(*a*), the ore supplying system 7 is provided above the top of the shaft furnace or vertical reduction furnace 4, and this ore supplying system comprises the hopper 9 and the pipe path 11 including the pressure equalizing chamber 10. The pressure equalizing chamber 10 is provided with a pipe path (not shown) for filling or removing inert gas such as nitrogen gas in or from the chamber under pressure, and the sealing valves 12 and 13 are provided respectively above and below the chamber 10. These sealing valves serve to prevent the atmospheric air from coming into the furnace or to prevent the furnace gas from leaking from the furnace while the ore is being supplied intermittently from the hopper 9 to the inside hopper 19.

Figure 5:
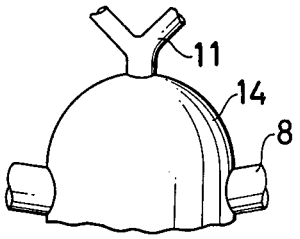
FIG. 5 schematically shows another embodiment according to the present invention.

The ore supplying system 7 may be embodied in various ways. In one embodiment, a pair of the pipe paths 11 are connected to the top dome wall 14 of the furnace 4 at two portions as shown in FIG. 4(*a*). In another embodiment the pipe paths 11 are collected together into one pipe path above the dome top of the furnace as shown in FIG. 5. From the aspect of the refractory brick structure of the top dome wall 14, the latter embodiment is more preferable.

As described above, the dividing plate 15 divides the furnace space into the upper portion and the lower portion, and the space 16 defined by the dividing plate 15 and the top dome wall 14 is used for storing the ore, and the dividing plate 15 is provided with one or more openings 17 at which pipes 18 are fixed and extend downward to flow down the ore 3 therethrough.

The number and arrangement of the openings 17 and the pipes 18 are determined from their relation with the inside diameter of the furnace at which the charge stock line is formed.

Figure 6:
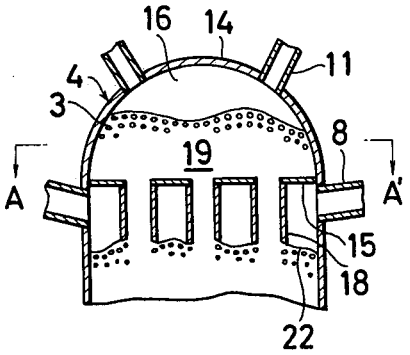
FIG. 6(*a*) schematically shows still another embodiment according to the present invention.
Figure 6:
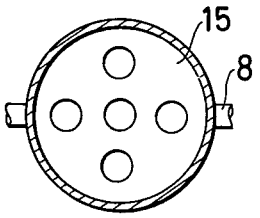

For example, two to four openings each with the pipe may be provided through the dividing plate equally spaced along the circumference connecting intermediate (almost center) points between the furnace center and the furnace wall, as shown in FIG. 4(*b*), or further one central opening with the pipe may be provided through the central portion of the dividing plate as shown in FIG. 6(*b*).

Further the number and arrangement of the pipes 18 may be determined in view of a desired pattern of the distribution of reducing gas flow in the furnace.

As described above, the inside ore hopper 19 is formed by the dividing plate 15 provided in the furnace 4, the pipes 18 and the wall 14 of the top portion of the furnace.

The inside hopper 19 is exposed to the same level of pressure as the furnace gas pressure itself, because it is formed within the furnace. Therefore, it is sufficient that the dividing plate 15 is of such a structure strong enough to support only the load of the ore 3 stored in the inside hopper, and it is not necessary to take into consideration its resistance to the furnace pressure.

The amount or level of ore 3 stored in the inside hopper 19 is controlled by the detector 21 so as to maintain continuous supply of the ore to the lower portion of the furnace.

Just below the inside hopper 19, there is formed the vacant space 20 defined by the charge stock line surface 22 with its summit at the lower end of the pipe 18. As one of the features of the present invention, the exhaust gas conduit 8 is connected to the vacant space 20 through the furance wall so as to take out the exhaust gas used for reduction of the ore in the furnace.

In the above embodiments, the pipes 18 extending downward from the inside hopper 19 must have a certain length determined from the relation with the furnace diameter at the exhaust gas taking-out portion so as to prevent non-uniform gas flow through the charge layer, and, on the other hand, the length of the pipes 18 have influence on the height of the furnace 4.

Various experiments conducted by the present inventors have revealed that the length of the pipes 18 should be determined in view of the furnace inside diameter at the level of the vacant space portion 20.

More specifically, it is desirable that the length of the pipes 18 is about $\frac{1}{3}$ of the furnace inside diameter at the level of the vacant space portion 20. When the length of the pipes 18 is increased beyond about a half of the furnace inside diameter, the vacant space portion 20 thus formed hardly contributes to prevent non-uniform gas flow through the charge layer. In other words, a useless vacant space portion 20 is formed and the height of the shaft furnace is increased to no purpose. On the other hand, when the length of the pipes 18 is shortened, the shortness may be compensated to a certain degree by increasing the number of the exhaust gas conduits 8 provided on the circumference of the vacant space portion 20. However, when the length of the pipes 18 is shorter than $\frac{1}{4}$ of the furnace inside diameter at the level of the vacant space portion 20, there is caused distinct difference in the gas flow between the central portion and the circumferential portion in the furnaces. Therefore, the length of the pipes 18 should not be shorter than $\frac{1}{4}$ of the furnace inside diameter at the level of the vacant space portion 20.

As described above, the shaft furnace according to the present invention is characterized in that the inside hopper 19 is formed within the top portion of the furnace by the dividing plate 15 instead of providing the ore hopper 3 of pressure-proof-structure separately outside the furnace. Therefore, the strength of the inside hopper 19 required for standing the furnace pressure is provided by the top dome portion of the furance itself. Also as the inside hopper 19 is formed by providing the dividing plate 15 in the top portion corresponding to the vacant space portion (gas taking-out portion) inherently required in the conventional shaft furnace, the height of the total furnace equipment as a whole including the ore supplying system 7 can be markedly reduced, and as the exhaust gas is taken out from the furnace at the portion just below the inside hopper 19, namely at the portion deviated from the top dome portion, it is possible to minimize the undesirable connection of various pipes to the top dome portion.

What is claimed is:

1. A shaft reduction furnace provided with a pressure equalizing chamber for receiving raw materials charged intermittently thereto and for charging the raw materials continuously into the furnace for supplying raw materials such as ore to the shaft furnace, said shaft furnace comprising:

wall means for forming a furnace chamber having generally vertically extending side walls and a dome wall forming a closure for the upper end of said furnace chamber, a dividing plate located within said furnace chamber extending transversely of said side walls and spaced downwardly from said dome wall and dividing said furnace chamber into an upper portion forming an ore storing space and a lower portion and said dividing plate having at least one opening therethrough;

at least one axially extending tubular member secured to and extending downwardly from the opening in said dividing plate into the lower portion of said furnace chamber and forming a pipe path extending downwardly from the dividing plate, through which the ore flows downwardly the lower end of said tubular member defining the summit of a charge stock line surface extending transversely across the lower portion of said furnace chamber, said ore storing space and the pipe path in combination constituting an inside ore hopper in said furnace chamber; and an exhaust gas conduit communcating through said side walls to a space formed between the dividing plate and the stock line of the ore charged below the dividing plate in the lower portion of said furnace chamber.

2. A shaft furnace according to claim 1, in which a plurality of said tubular members extend downwardly from openings in said dividing plate and form a plurality of pipe paths, said tubular members being equally spaced apart.

3. A shaft furnace according to claim 1, in which the pipe path formed by said tubular member has a length about $\frac{1}{2}$–$\frac{1}{4}$ of the diameter of the lower portion of said furnace chamber formed below the dividing plate.

4. A shaft furnace according to claim 1, which further comprises means for controlling the level of ore charged in the inside ore hopper.

* * * * *